US007536868B1

(12) United States Patent
Ward

(10) Patent No.: US 7,536,868 B1
(45) Date of Patent: May 26, 2009

(54) TEMPERATURE CONTROLLED CART

(76) Inventor: Richard W. Ward, 141 Prospect Rd., Loris, SC (US) 29569

( * ) Notice: Subject to any disclaimer, the term of this patent is extended or adjusted under 35 U.S.C. 154(b) by 400 days.

(21) Appl. No.: 11/316,433

(22) Filed: Dec. 22, 2005

(51) Int. Cl.
*F25D 15/00* (2006.01)

(52) U.S. Cl. ..... 62/237; 62/258

(58) Field of Classification Search ..... 62/237, 62/246–256, 258
See application file for complete search history.

(56) References Cited

U.S. PATENT DOCUMENTS

| | | | | |
|---|---|---|---|---|
| 3,733,836 | A | 5/1973 | Corini | |
| 4,655,052 | A | 4/1987 | Garcia | |
| 4,879,789 | A * | 11/1989 | Bak | 27/11 |
| 4,920,760 | A * | 5/1990 | Muhlack | 62/255 |
| 4,941,327 | A | 7/1990 | Miles | |
| 5,249,435 | A * | 10/1993 | Lever et al. | 62/419 |
| 5,261,253 | A | 11/1993 | Spenard | |
| D353,304 | S | 12/1994 | Friedrich | |
| 5,417,079 | A * | 5/1995 | Rudick et al. | 62/253 |
| 5,549,373 | A | 8/1996 | Bustos | |
| 5,590,541 | A | 1/1997 | Rainwater | |
| 5,797,445 | A | 8/1998 | Westbrooks, Jr. et al. | |
| 6,128,912 | A | 10/2000 | Wetzel | |
| 6,305,185 | B1 | 10/2001 | Sloan | |
| 6,745,588 | B2 | 8/2004 | Kahler | |
| 7,032,401 | B2 * | 4/2006 | Dresser | 62/246 |
| 7,062,931 | B2 * | 6/2006 | Wilson | 62/255 |
| 7,269,964 | B2 * | 9/2007 | Hand | 62/258 |
| RE40,151 | E * | 3/2008 | Shei et al. | 62/252 |

FOREIGN PATENT DOCUMENTS

BG 002248015 A 3/1992

* cited by examiner

*Primary Examiner*—William E Tapolcai

(57) ABSTRACT

A temperature controlled cart for carrying items such as food, beverages, and menu items. The cart includes a heated or refrigerated compartment for storing the items. A temperature control unit carried in a drawer selectively heats or cools the compartment, and a self-contained power source powers such unit. A food preparation surface is provided on a top of the cart for preparation of menu items from items carried in the compartment. A heating element may also be provided on the top of the cart for selectively heating food and beverage items. A display board is carried on the front end of the cart for displaying menu items, and a door is operably mounted in a side of the cart for allowing access to the item carried in the refrigerated compartment.

20 Claims, 4 Drawing Sheets

TEMPERATURE CONTROLLED CART

BACKGROUND OF THE INVENTION

The present invention relates to a temperature controlled cart for carrying food and beverage items, medicine and medical supplies, and commercial and industrial supplies.

In certain restaurants, dessert trays or carts are brought to a diner's table in order to showcase dessert items available for purchase. Such items are sometimes real, and other times are actually imitation dessert items, made from plastic, or other materials. Because of the relative short shelf life that certain dessert items may have, having means by which such items can be maintained fresh and also displayed to diners in an attractive fresh manner would be desirable.

In addition to dessert sales in a restaurant, other food items, such as meat, seafood, etc. may be brought to the table for viewing and selection by a diner prior to such items being prepared. It is desirable in these cases to maintain such food items in a refrigerated environment in order to reduce the chance of contamination by germs and bacteria.

Also, certain medicines, medical supplies and commercial and industrial materials may require transport and storage in temperature controlled environments in order to optimize their use.

SUMMARY OF THE INVENTION

Generally, the present invention includes an apparatus for carrying foods, beverages and menu items, and other items, such as medicines, medical supplies, and commercial and industrial supplies, and has a box structure with a top portion, a bottom portion, a first side portion, a second side portion, a front end, and a rear end which, together, define a box compartment. The box compartment is configured for storing items, and wheels are connected to the bottom portion of the box structure for allowing movement of the box structure. A temperature control system, such as refrigeration and/or heating unit, is connected to the box structure for selectively heating and/or cooling the box compartment.

A self-contained power source is connected to and powers the temperature controlled system. A preparation surface is provided on the top portion of the box structure for preparation of items, such as menu items using foods and beverages from the box compartment. A display board is carried on the front end of the box structure for displaying menu items or other information about the contents of the box compartment, and a door is operably mounted in the first side of the box structure for allowing access to the items carried in the box compartment.

More specifically, one preferred embodiment of the present invention may include a heating element provided on the top portion for selectively heating food and beverage items, and wherein the self-contained power source includes at least one direct current battery, and further, an alternating current-supplied electrical charger for selectively charging the battery.

A drawer is carried by the box structure and is extendable from the rear end of the box structure and carries the temperature control system, the battery, and the electrical charger. The temperature control system may include a fan configured to force an air flow downwardly through the bottom portion of the drawer and the box structure.

A utility container is, in one preferred embodiment, detachably mounted to the rear end of the box structure, and at least one light is provided in the box compartment connected to the self-contained power source. A utensil holder may also be mounted to the first side of the box structure for carrying utensils. Additionally, a utensil hanger can be connected to the box structure for also carrying utensils. The top portion of the box structure may be configured to define a recess for carrying food, beverages, utensils, dishes, and menu items. Further, a cutting board can be provided in the top portion of the box structure.

A transparent panel can be provided in the second side of the box structure for allowing viewing of the interior of the box compartment. Also, a door may be provided in the top portion of the box structure for selectively allowing access to the box compartment. Further, a shelf may be provided in the utility box compartment for carrying items therein.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
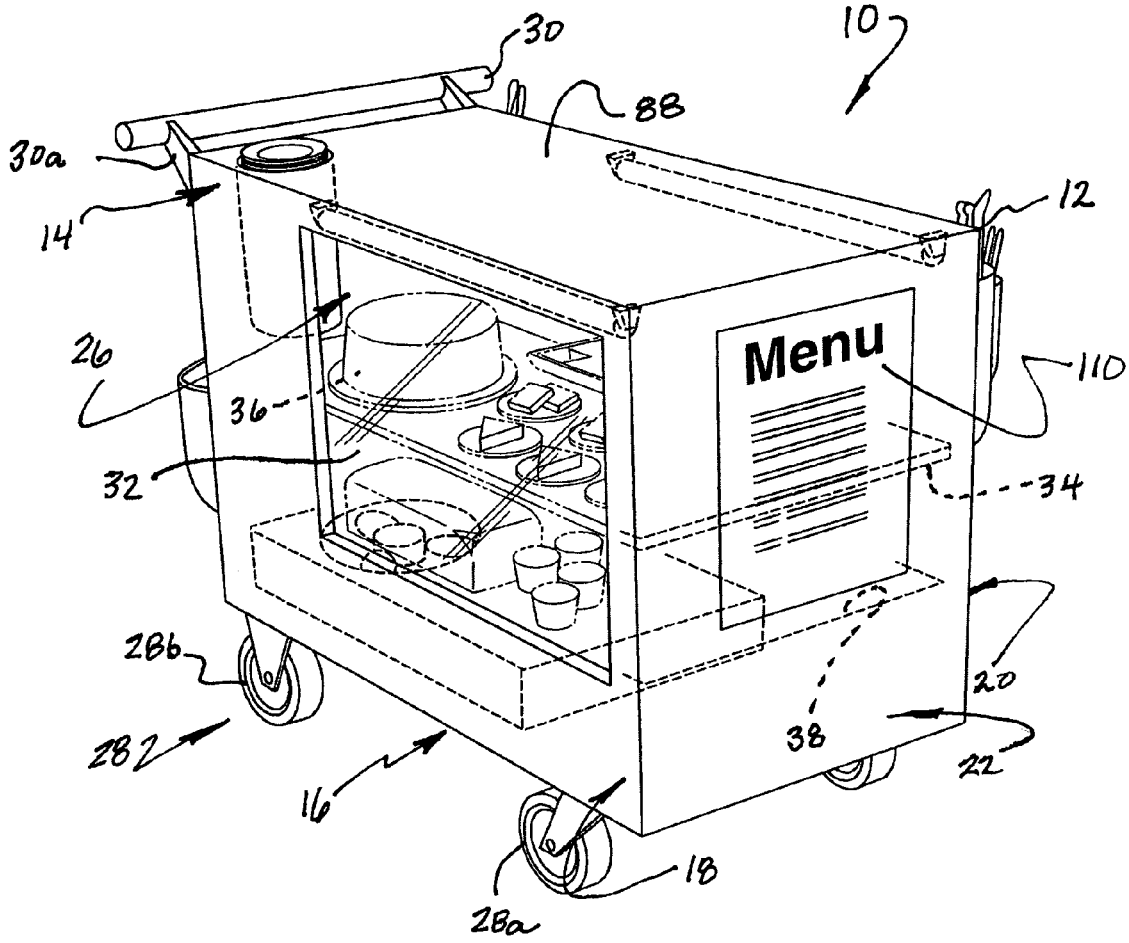
FIG. 1 is a partial perspective view of a temperature controlled cart constructed in accordance with the present invention.

The foregoing, as well as other objects of the present invention, will be further apparent from the following detailed description of the preferred embodiment of the invention, when taken together with the accompanying drawings and the description which follows set forth this invention in its preferred embodiment. However, it is contemplated that persons generally familiar with refrigerated and/or heated devices will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the temperature controlled cart of the present invention is indicated generally in the figures by reference character 10.

Turning to FIG. 1, refrigerated restaurant cart 10 includes a box structure, generally 12, having a top portion, generally 14, a bottom portion, generally 16, a first side portion, generally 18, a second side portion, generally 20, a front end 22, and a rear end, generally 24, which together define a temperature-controlled box compartment, or, compartment, generally 26. Four wheels, generally 28, are provided on bottom portion 16 of cart 10, with the wheels 28*a* adjacent the front end 22 preferably being caster wheels to allow cart 10 to be readily steered as it is pushed along, for example, by a user grasping and pushing on handle 30, which is connected via supports 30*a* to rear end 26 of cart 10. It is to be understood, however, that rear wheels 28*b* could be caster wheels, instead of, or in addition to, front wheels 28*a* being caster wheels. Further, wheels 28 can include a locking mechanism (not shown) for selectively locking rotation of one or more wheels 28 in order to act as a brake for cart 10, for selectively preventing movement of cart 10.

Figure 2:
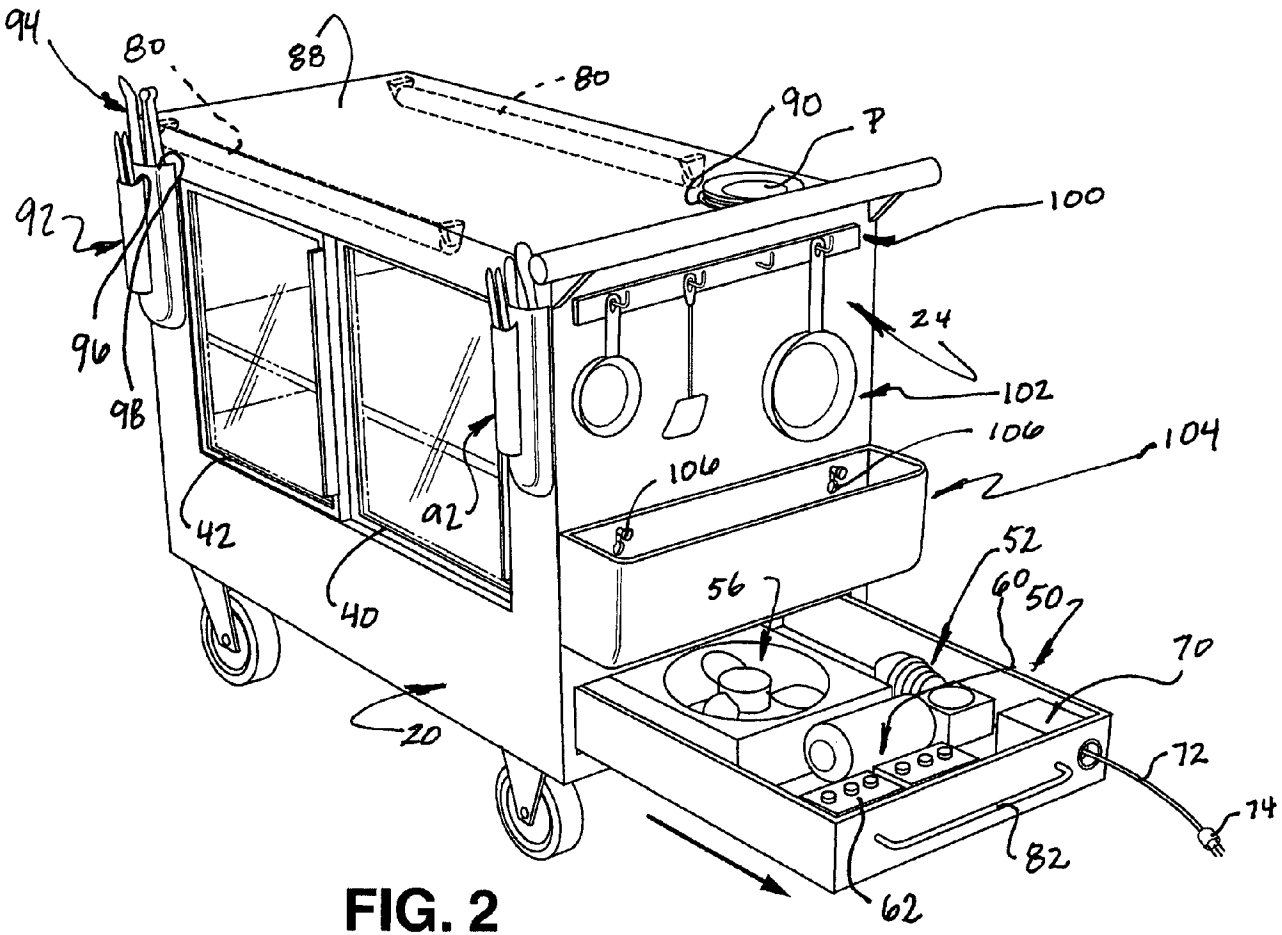
FIG. 2 is another perspective view of the temperature controlled cart illustrated in FIG. 1.

In the embodiment shown in FIGS. 1 and 2, cart 10 includes on a first side thereof a transparent panel, generally 32, which could be glass, plexi-glass, etc., and which allows box compartment 26, and the contents therein, to be easily viewed from a side of cart 10. A shelf 34 is provided within compartment 26 for supporting items, generally 36, and such shelf is preferably adjustable within compartment 26 such that its height may be varied with respect to floor 38 of compartment 26 to accommodate items of differing heights. Floor 38 of compartment 26 also acts as a shelf for storing items such as food and/or beverage items 36 while such items 36 are cooled and/or heated within compartment 26. It is to be understood that items other than food and beverages could also be stored in compartment 26.

As shown in FIG. 2, a set of doors, 40, 42, are provided in the second side 20 of cart 10. Doors 40 and 42 can be swinging doors, or could be siding doors, as shown in FIG. 2, with one or more door panels being slidable to allow access to compartment 26. Preferably, doors 40, 42 are of a bi-pass design, such that either door may be slidingly moved to an open or closed position independent of the other door.

A drawer, generally 50, is provided in lower portion 18 of cart 10 and carries therein a temperature control unit, generally 52, which could be a refrigeration system and/or heat pump system, having a compressor system and a condenser fan, or blower, generally 56, for directing air downwardly through an opening (not shown) in the bottom of drawer 50 and through an opening (not shown) in the bottom 16 of cart 10 such that the air flow developed by unit 52 is primarily directed to the floor or surface on which cart 10 rests, instead of being outwardly directed from the sides, front, or rear of cart 10.

Drawer 50 also includes a self-contained power source, generally 60, connected to unit 52. In one preferred embodiment, direct current batteries, generally 62, are used as power source 60. It is to be understood, however, although not shown, that other power sources could be used, such as, for example, a kerosene-based refrigeration system, a propane heating and/or cooling system, etc., if desired.

An electrical charging unit, generally 70, is also provided in drawer 50 for providing a direct current charging output to charge batteries 62, and includes an automatic shutoff system for discontinuing charging of batteries 62 when such are fully charged. Connected to charging unit 70 is a power cord, generally 72, having a plug 74 for insertion into a typical alternating current receptacle, for providing alternating current power to charging unit 70. Charging unit 70 preferably includes an alternating current to direct current converter for providing direct current for use in charging batteries 62. A cord retraction unit is also included in charger 70 for automatically retracting cord 72 once plug 74 has been removed from an alternating current power source (not shown).

Compartment 26 is preferably provided with lights 80 which, in one preferred embodiment, are fluorescent lights of relatively low power consumption in order to maximize the run time of unit 52 when such is running on direct current battery power. It is to be understood, however, that in certain applications, power cord 72 could be maintained plugged into an alternating current source, with unit 52 being run on alternating current power while cart 10 is either maintained in a stationary position or moved over limited distances.

Unit 52 also includes a thermostat and thermostat control (not shown) for allowing for the interior temperature of compartment 26 to be set and maintained through cycling unit 52 on and off.

Drawer 50 can also be provided with additional space to allow storage of other items in addition to unit 52, batteries 62, and charging unit 70, if desired. A handle 82 is provided on the front 84 of drawer 50 in order to allow drawer 50 to be moved to an extended position, as shown in FIG. 2, from a retracted position, as shown in FIG. 1.

Top portion 14 of cart 10 includes a preparation surface, generally 88, which can be used when cart 10 carries food and/or drink items for preparation of menu items using food and/or drink items carried within compartment 26 and/or on surface 88, or otherwise on cart 10. As shown in FIGS. 1 and 2, top surface 88 can include a recess or receptacle, generally 90, for carrying plates P or other dinner service items, and also includes receptacles, generally 92, attached to the second side 20 of cart 10 for carrying cooking utensils, generally 94. Receptacles 92 can preferably each include a first compartment 96 and a second compartment 98 for carrying various utensils, generally 94. Also, a utensil hanger, generally 100, can be provided on the rear end 24 of cart 10 for carrying cooking items, such as pans, pots, etc., generally 102, and other cooking utensils, such as a spatula, etc.

Detachably mounted to rear end 24 is a utility container, generally 104, which can be easily attached to and removed from cart 10 through engagement of slots 106 defined in utility container 104 with posts 106 on cart rear end 26, which may include enlarged heads. Container 104 can be used for carrying food and/or utensil items, pots, pans, sanitizing solutions, soapy water, trash and debris, etc. Although not shown, container 104 can include a cover for sealing container 104, if desired.

As shown in FIG. 1, preferably mounted on the front end 22 of cart 10 is a menu display, generally 110, which lists those menu items which are ready-to-eat and/or which can be prepared from food and/or beverage items carried by cart 10. These items could list, for example, desserts which could be made by a server at a diner's table, in order to help the diner make a selection of a dessert item. If cart 10 is being used to also carry items other than food, then menu display 110 could also list such other items. Preferably, menu display 110 is readily changeable, and could be on a dry erase board, chalkboard, illuminated plexi-glass, Lexan, Lucite, etc. board on which menu items are written in regular and/or fluorescent inks, etc. Further, menu display 110 could include a transparent plastic sleeve into which paper stock menus are inserted, it being understood that the menu board of the present invention could include one or more of the foregoing and/or combinations thereof.

Figure 3A:
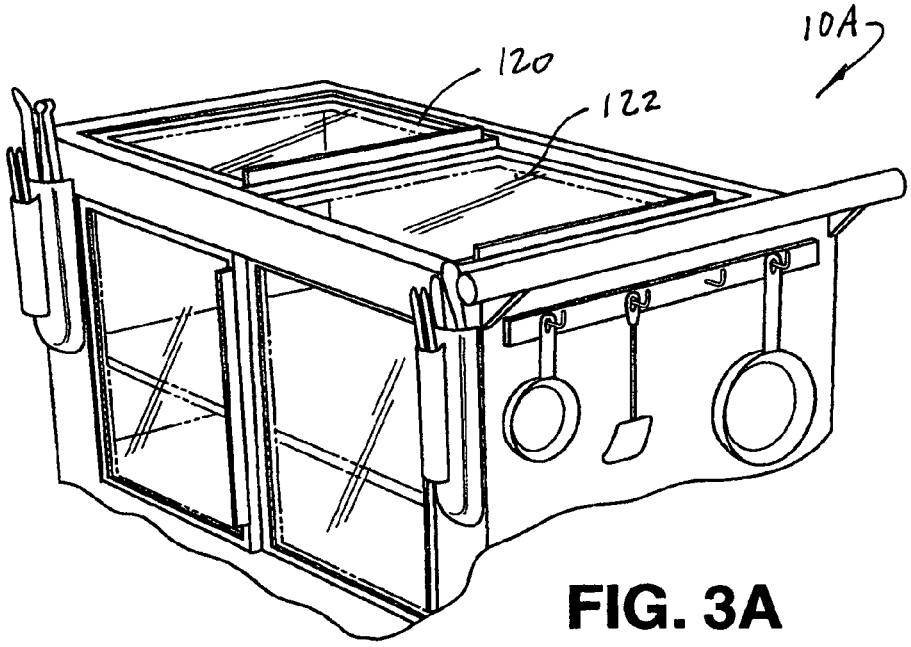
FIG. 3A is a partial perspective view of an alternate embodiment temperature controlled cart constructed in accordance with the present invention.
Figure 3B:
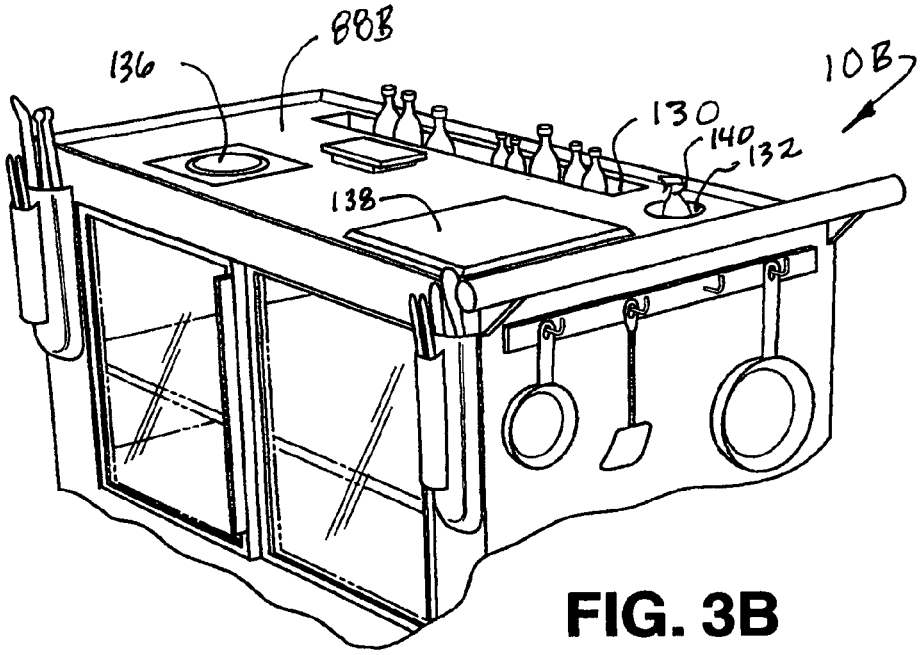
FIG. 3B is a partial perspective view of a further alternate embodiment of a temperature controlled cart constructed in accordance with the present invention.
Figure 3C:
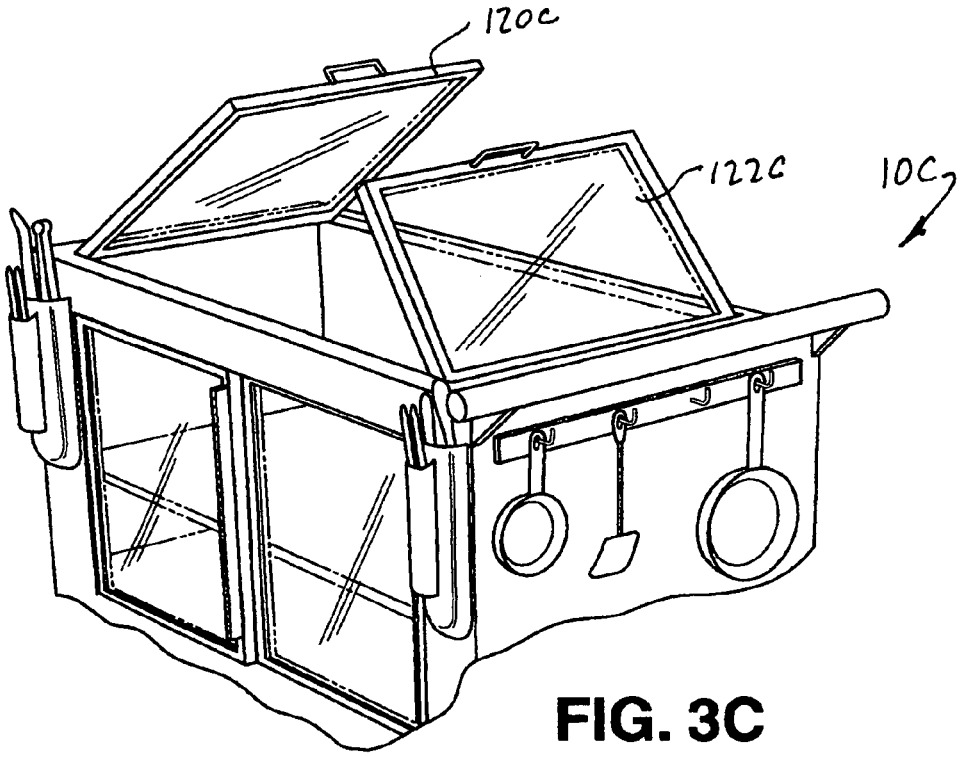
FIG. 3C is a partial perspective view of yet another alternate embodiment of a temperature controlled cart constructed in accordance with the present invention.

Turning to FIGS. 3A through 3D, alternate embodiments of cart 10 of the present invention will be discussed. FIG. 3A illustrates restaurant cart 10A, wherein glass doors 120, 122 such as bi-pass-type sliding glass, doors, are provided to be accessed from the top portion of cart 10A. As shown in FIG. 3C, glass doors 120C, 122C can be pivotally mounted to swing upwardly from the top 114 of cart 10C. In either of the embodiments shown in FIGS. 3A and 3C, such glass doors could be used as food preparation surfaces, as desired. Such embodiments 10A and 10C of the present invention may find particular use for environments where ready-made, chilled or warmed desserts, food and/or drink items, medicines, medical supplies, commercial and industrial materials and supplies, etc. are to be dispensed.

FIG. 3B illustrates a further alternate embodiment 10B of the present invention and includes receptacles 130, 132 provided in the top surface of cart 10C. Also provided on food preparation surface 88B is a heating element, generally 136, for heating menu items being prepared. Such items could, for example, include a dessert item such as Bananas Foster, or entree items, if desired. Burner 136 could be an electric burner, powered by the self-contained power source 60, or could be gas powered, with bottled gas being provided thereto. Bottled gas, such as propane, butane, LP gas, or otherwise, could be provided in containerized form, with such container being carried by cart 10, such as in drawer 50, and/or on surface 88B, and connected to burner 136.

A cutting board 138 is provided on the surface for use in cutting food items in preparation of menu items. Receptacles 130, 132 can be used for carrying condiments, sauces, or other ingredients in food preparation. Additionally, a spray sanitizing solution, generally 140, could be carried within receptacle 132 for cleaning food preparation surface 88B, when desired.

Figure 3D:
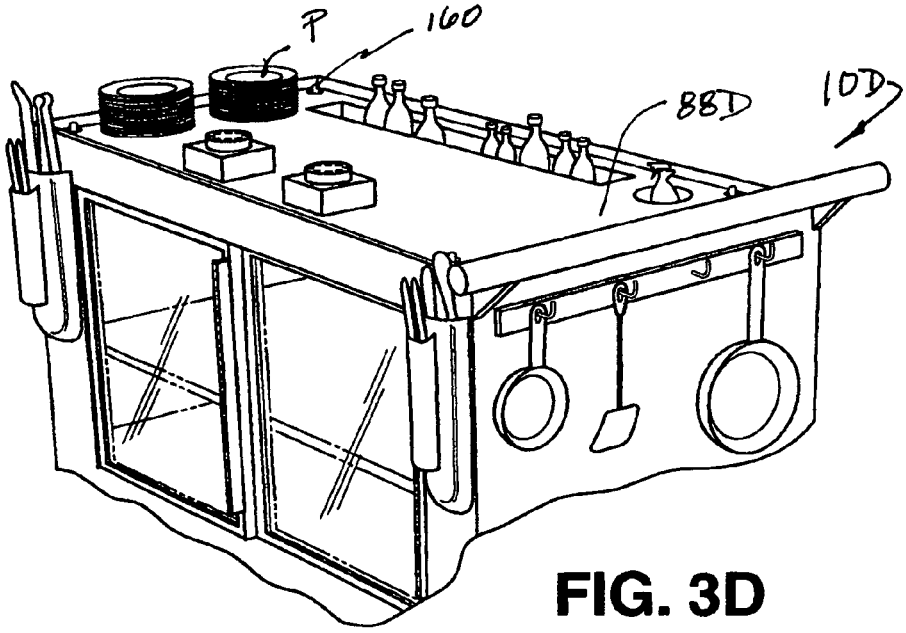
FIG. 3D is a partial perspective view of a still further alternate embodiment of a temperature controlled cart constructed in accordance with the present invention.

FIG. 3D illustrates a further embodiment of the present invention, where sterno-type burners, generally 150, are provided instead of gas and/or electric element or burner 136 discussed above.

Surface 88D also supports plates P used for menu items. Surface 88D is preferably detachable from cart 10D, and includes fasteners, generally 160, at each corner thereof. Such fasteners could include holes defined in surface 88D which engage with cart 10D, or could include other fasteners, such as clips, pins, bolts, screws, snaps, Velcro, magnets, adhesive, or other suitable fastening devices.

While the present invention is particularly suited for use in a restaurant for dispensing food and/or beverage items which are ready-made, and/or for preparation of food items carried within compartment 26 into menu items, it can also find use in residential medical, industrial, and commercial applications as well.

In a further variation of the present invention, compartment 26 could be heated, instead of cooled, with unit 52 being a heating device such as a heat pump unit which allows for compartment 26 to be either cooled or heated, as desired. With compartment 26 being heated, items such as food could be kept warm, and in the case of ready-made food items, such items could be stored in compartment 26 and dispensed directly therefrom. Other food items could be kept warm and then prepared as menu items through further preparation, including using heating element 136, and provided to patrons as prepared menu items.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. An apparatus for carrying items including foods, beverages and menu items, the apparatus comprising:

a box structure having top portion, a bottom portion, a first side portion, a second side portion, a front end, and a rear end together defining a box compartment; said box compartment being configured for storing the foods, beverages, and menu items;

wheels connected to said bottom portion of said box structure for allowing movement of said box structure;

a door operably mounted in said first side for allowing selective access to said box compartment;

a drawer carried by said box structure, said drawer being extendable from said rear end of said box structure;

means for selectively cooling said box compartment;

at least one battery carried in said drawer for providing power to said means for selectively cooling said box compartment;

an electrical charger carried in said drawer for selectively charging said at least one battery;

at least one light in said box compartment connected to said self-contained power source;

at least one shelf in said box compartment for carrying the items;

at least one utensil holder mounted to said first side of said box structure for carrying utensils;

at least one heating element provided on said top portion for selectively heating the items;

a transparent panel provided in said second side of said box structure for allowing viewing of said box compartment;

a food preparation surface provided on said top portion of said box structure for preparation of menu items using the items; and a display board carried on said front end of said box structure for displaying the menu items.

2. An apparatus for carrying items including foods, beverages, and menu items, comprising:

a box structure having top portion, a bottom portion, a first side portion, a second side portion, a front end, and a rear end together defining a box compartment; said box compartment being configured for storing the items;

wheels connected to said bottom portion of said box structure for allowing movement of said box structure;

a refrigeration unit connected to said box structure for selectively cooling said box compartment;

a self-contained power source connected to said refrigeration unit for powering said refrigeration unit;

a food preparation surface provided on said top portion of said box structure for preparation of menu items using items carried in said box compartment;

at least one heating element provided on said top portion for selectively heating the food and beverage items;

a display board carried on said front end of said box structure for displaying the menu items; and a door operably mounted in said first side for allowing access to the items carried in said box compartment.

3. An apparatus as defined in claim 2, wherein said self-contained power source includes at least one direct current battery, and further comprising an alternating current-supplied electrical charger for selectively charging said at least one battery.

4. An apparatus for carrying items including foods, beverages, and menu items, comprising:

a box structure having top portion, a bottom portion, a first side portion, a second side portion, a front end, and a rear end together defining a box compartment; said box compartment being configured for storing the items;

wheels connected to said bottom portion of said box structure for allowing movement of said box structure;

a refrigeration unit connected to said box structure for selectively cooling said box compartment;

a self-contained power source connected to said refrigeration unit for powering said refrigeration unit;

a food preparation surface provided on said top portion of said box structure for preparation of menu items using items carried in said box compartment;

a display board carried on said front end of said box structure for displaying the menu items;

a door operably mounted in said first side for allowing access to the items carried in said box compartment;

an alternating current-supplied electrical charger for selectively charging said self-contained power source; and a power cord connected to said electrical charger and carried by said box structure for supplying alternating current to said electrical charger.

5. An apparatus as defined in claim 2, further comprising a drawer carried by said box structure, said drawer being extendable from said rear end of said box structure and defining a storage compartment.

6. An apparatus as defined in claim 2, further comprising a drawer carried by said box structure, said drawer being extendable from said rear end of said box structure and carrying said refrigeration unit.

7. An apparatus as defined in claim 2, wherein:

said self-contained power includes at least one direct current battery; and further comprising:

an electrical charger for selectively charging said at least one battery; and a drawer carried by said box structure, said drawer being extendable from said rear end of said box structure and carrying said refrigeration unit, said at least one direct current battery, and said alternating current-supplied electrical charger.

8. An apparatus as defined in claim 2, further comprising said refrigeration unit including a fan and said fan being configured to provide an air flow downwardly through said bottom portion of said box structure.

9. An apparatus as defined in claim 2, further comprising a utility container detachably mounted to said rear end of said box structure.

10. An apparatus as defined in claim 2, further comprising at least one light in said box compartment connected to said self-contained power source.

11. An apparatus as defined in claim 2, further comprising at least one shelf in said box compartment for carrying foods and beverages.

12. An apparatus as defined in claim 2, further comprising at least one utensil holder mounted to said first side of said box structure for carrying utensils.

13. An apparatus as defined in claim 2, further comprising said top portion of said box structure defining a recess for carrying items.

14. An apparatus as defined in claim 2, further comprising a transparent panel provided in said second side of said box structure for allowing viewing of said box compartment.

15. An apparatus as defined in claim 2, further comprising said at least one door provided in said top portion of said box structure for selectively allowing access to said box compartment.

16. An apparatus as defined in claim 2, further comprising a utensil hanger connected to said box structure for carrying utensils.

17. An apparatus as defined in claim 2, further comprising a cutting board provided in said top portion of said box structure.

18. An apparatus as defined in claim 2, wherein said door is hingedly mounted to said box structure for pivoting between an open position and a closed position.

19. An apparatus as defined in claim 2, wherein said door is slidingly mounted to said box structure for sliding between an open position and a closed position.

20. An apparatus for items to be temperature controlled, the apparatus comprising:

a box structure having top portion, a bottom portion, a first side portion, a second side portion, a front end, and a rear end together defining a box compartment; said box compartment being configured for storing the items;

wheels connected to said bottom portion of said box structure for allowing movement of said box structure;

a drawer carried by said box structure, said drawer being extendable from said rear end of said box structure;

means for selectively controlling the temperature of said box compartment;

at least one battery carried in said drawer for providing power to said means for selectively controlling the temperature of said box compartment;

an electrical charger carried in said drawer for selectively charging said at least one battery; and a display board carried on said front end of said box structure for displaying the items stored in the box compartment.

* * * * *